US008353623B2

(12) United States Patent
Calabrese et al.

(10) Patent No.: US 8,353,623 B2
(45) Date of Patent: Jan. 15, 2013

(54) TIMEPIECE MOVEMENT INCLUDING A KARUSSEL

(75) Inventors: Vincent Calabrese, Lausanne (CH); Edmond Capt, Le Brassus (CH); Sébastien Graf, Le Mont-sur-Lausanne (CH); Marco Rochat, Le Brassus (CH)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 12/601,418

(22) PCT Filed: May 21, 2008

(86) PCT No.: PCT/EP2008/056280

§ 371 (c)(1),
(2), (4) Date: May 27, 2010

(87) PCT Pub. No.: WO2008/142120

PCT Pub. Date: Nov. 27, 2008

(65) Prior Publication Data

US 2010/0246338 A1 Sep. 30, 2010

(30) Foreign Application Priority Data

May 23, 2007 (EP) ..... 07108771

(51) Int. Cl.
*G04B 15/00* (2006.01)
*G04B 19/20* (2006.01)

(52) U.S. Cl. ..... 368/127; 368/140

(58) Field of Classification Search ..... 368/127, 368/140

See application file for complete search history.

(56) References Cited

U.S. PATENT DOCUMENTS

| | | | | |
|---|---|---|---|---|
| 5,608,694 | A * | 3/1997 | Grimm et al. | 368/127 |
| 6,402,368 | B1 | 6/2002 | Grimm et al. | |
| 7,527,423 | B2 * | 5/2009 | Ruchonnet et al. | 368/127 |
| 7,946,755 | B2 * | 5/2011 | Greubel et al. | 368/127 |
| 2005/0243652 | A1 * | 11/2005 | Taillard et al. | 368/35 |

FOREIGN PATENT DOCUMENTS

| | | |
|---|---|---|
| CH | 7965 | 1/1894 |
| EP | 0 973 076 A1 | 1/2000 |
| WO | 2004/006025 A2 | 1/2004 |

(Continued)

OTHER PUBLICATIONS

Théorie d'horologerie, 7.12.2 "Le carrousel/(The carousel)," Swiss Federation of Technical Colleges (1999), p. 168.

(Continued)

*Primary Examiner* — Sean Kayes
(74) *Attorney, Agent, or Firm* — Griffin & Szipl, P.C.

(57) ABSTRACT

The timepiece movement includes a barrel, an escapement that has an escape wheel and pinion (27, 25), a balance (19) and a gear train for transmitting energy stored in the barrel to the escape wheel. This gear train has an intermediary wheel (23), kinematically connected to the barrel by a first part of the gear train, and kinematically connected to the escape wheel (27) by a second part of the gear train, the second part of the gear train, and the escapement and balance are mounted in a rotating carriage (16) kinematically connected to the movement and arranged for rotating coaxially about the intermediary wheel (23) at a different speed from the speed of the intermediary wheel. The timepiece movement is characterized in that it imposes a speed of one revolution per minute on the carriage (16).

14 Claims, 7 Drawing Sheets

FOREIGN PATENT DOCUMENTS

WO 2006/056229 A1 6/2006

OTHER PUBLICATIONS

International Search Report issued in corresponding application No. PCT/EP2008/056280, completed Aug. 1, 2008 and mailed Aug. 11, 2008.

Daniels, George, "Watchmaking", Philip Wilson Publishers, 1981, pp. 298-299.

Geethu Lawrence, Blancpain Historical Timepieces—Carrousel Volant Une Minute (2008)—World's First Karussel Wristwatch Movement, Horozima (Sep. 13, 2009, 3:45 PM), http://www.horozima.com/2009/09/blancpain-historical-timepieces_1827.html.

Jeffery S. Kingston, No Holds Barred II, Letters du Brassus, No. 4, 2008 at 10-11, available at http://www.blancpain.com/en/lettres-du-brassus.

Magnus Bosse, Blancpain presents 'Carrousel Volant Une Minute', PuristSPro (Apr. 17, 2008), http://blancpain.watchprosite.com/?show=nblog.post&ti=423961&fi=4.

Kong, Blancpain Carrousel with Vincent Calabrese at SWA, PURISTSPRO (Dec. 13, 2009), http://blancpain.watchprosite.com/?show=nblog.post&ti=569526 (detailing a lecture by Vincent Calabrese at Sincere Watch Academy on "The Tourbillon versus the Carrousel").

Wrist-Borne Whirlwinds, Watchtime, Oct. 2001, at 58, available at http://www.watchtime.at/archive/wt_2001_05/WT_2001_05_052.pdf (including a note on the differences between a tourbillon and a karussel).

Elizabeth Lilly Doerr, Selection 2010—L-Evolution Carrousel Volant Une Minute by Blancpain, WORLDTEMPUS (Dec. 23, 2010, 8:00 AM), http://www.worldtempus.com/en/news/top-news/detail/article/1292940919-selection-2010-l-evolution-carrousel-volant-une-minute-by-blancpain/ (briefly explaining the differences between a tourbillon and a karussel).

Jaw, Tourbillon vs. Karussel, the debate continues . . . , PURISTPRO (Jan. 16, 2003, 8:08 AM), http://jlc.watchprosite.com/show-forumpost/fi-128/pi-1729807/ti-265670/gridviewer-1/ (quoting Charles-Andre Reymondin et al., The Theory of Horology 168 add. (The Swiss Federation of Technical Colleges eds., 2003).

Ariel Adams, Haute Timepieces: Blancpain Carrousel Répétition Minutes Le Brassus Watch, Haute Time (May 3, 2010) http://www.hauteliving.com/2010/05/haute-timepieces-blancpain-carrousel-repetition-minutes-le-brassus-watch/ ("a movement . . . [that] is lovely to view in its full operational glory").

Feature: Blancpain Carrousel Répétition Minutes, Professional Watches (May 2, 2010), http://professionalwatches.com/2010/05/baselworld_2010_teaser.html (an "exceptional timepiece [that] presents several technical innovations").

Watchonista Blog, Blancpain Le Brassus Carrousel Volant 1 Minute, Watchonista (Sep. 27, 2011, 6:46 PM), http://www.watchonista.com/2914/watchonista-blog/news/blancpain-le-brassus-carrousel-volant-1-minute ("[t]he Carrousel is a way to immediately get out of the Tourbillon's beaten tracks").

Ashok Soman, Blancpain Carrousel Tourbillon, Luxury Insider (Jun. 25, 2008), http://www.luxury-insider.com/luxury-news/2008/06/blancpain-carrousel-tourbillon.

* cited by examiner

TIMEPIECE MOVEMENT INCLUDING A KARUSSEL

This is a National Phase Application in the United States of International Patent Application No. PCT/EP2008/056280 filed May 21, 2008, which claims priority on European Patent Application No. 07108771.2, filed May 23, 2007. The entire disclosures of the above patent applications are hereby incorporated by reference.

FIELD OF THE INVENTION

The present invention generally concerns mechanical timepiece movements wherein the portion of the going train that kinematically connects an intermediary wheel to the escape wheel is mounted on a rotating platform, which also carries the escapement and the balance, and wherein said platform is also driven by the movement to rotate about the axis of the intermediary wheel at a different speed from the intermediary wheel speed.

BACKGROUND OF THE INVENTION

Timepiece movements that match the above definition are already known. CH Patent No. 7965, in particular, discloses a movement of this type with reference to drawings, one of which is reproduced in FIG. 1 annexed to this document. The movement disclosed includes a going train of which only the last two wheel sets are shown. There is a wheel set formed by the third pinion and the third wheel (respectively referenced G and H), and the wheel set formed by the fourth pinion and wheel (respectively referenced A and C). The document specifies that the fourth wheel (or intermediary wheel) C drives the escape (not shown) in a known manner. Moreover, the escape and the balance E are mounted on a platform F. The bottom surface of platform F has a thick cylindrical pivot B which is inserted to rotate in an aperture of a plate P. Cylindrical pivot B is hollow and shaped to let the arbour of the fourth wheel set pass through it, so that platform F and the fourth wheel rotate about the same axis. Finally the third pinion G is for driving platform F in rotation, via a wheel D, which is pierced in the middle and screwed to the platform, concentrically to the axis of rotation of said platform.

In the example disclosed by this prior art document, third wheel H is driven in quite a conventional manner at a speed of one revolution per 7½ minutes. Third pinion G has seven times fewer teeth than wheel D with which it meshes, and platform F therefore competes one revolution every 52½ minutes. Moreover, fourth pinion A has 7½ times fewer teeth than third wheel H. Fourth pinion A thus conventionally completes exactly one revolution per minute. Since the rotational speed of fourth wheel C is determined by the escapement, which itself rotates, with platform F, in the same direction as fourth wheel C, the frequency of balance E has to be decreased by approximately 2% to take account of the speed of platform F.

Those skilled in the art will have recognised a karussel in the above description. Upon reading this description, it is clear that the karussel mechanism is completely different from a tourbillon mechanism. Indeed, as in an ordinary watch, with a karussel, the energy from the barrel is transmitted to the escape wheel via the fourth wheel. The movement drives the platform via an additional gear, and if this gear is uncoupled, the watch can continue to function while the platform is no longer rotating.

According to the work entitled, "La montre: principes et méthodes de fabrication" (pages 298-9), the karussel compensates for poising defects in the balance just as well as the tourbillon. Moreover, it is easier to make and produce in large quantities. However, for watch specialists and collectors the tourbillon is more attractive to look at. It is therefore an object of the present invention to provide a timepiece movement fitted with a karussel that has the same aesthetic qualities as a tourbillon. The invention achieves this object by providing a timepiece movement in accordance with the following disclosure.

SUMMARY OF THE INVENTION

According to the present invention, when the movement is working, the carriage rotates at a speed of one revolution per minute. Implementation of this technical feature is not self-evident. Indeed, in karussels of the prior art, the fourth wheel also completes one revolution per minute. Now, if the fourth wheel and the carriage were rotating at the same speed, the escape wheel would not be driven. Thus, according to the present invention, the speed of the fourth wheel is not one revolution per minute. This wheel is not therefore actually a fourth wheel, but a false-fourth wheel or, more simply, an intermediary wheel. Moreover, since its speed is not one revolution per minute, it cannot be used to carry the seconds indicator of a timepiece. However, in a timepiece fitted with a movement according to the present invention, the carriage may advantageously be visible on the dial side and itself carry means for indicating the seconds.

One might be tempted to summarize the annexed claim 1, by saying that it defines a karussel, characterized in that it is arranged to rotate at the speed of one revolution per minute. However, it should be specified that watchmaking literature contains two incompatible definitions of a karussel. This Application uses the term "karussel" in its conventional sense, which includes all the features of the preamble of claim 1. However, the work entitled "Théorie d'horologerie" gives another definition for a karussel. According to this more recent definition, a karussel is simply a tourbillon in which the balance is off-centre relative to the axis of rotation of the carriage. Evidently, based on this second definition, a karussel that rotates at the speed of one revolution per minute is something that is well known to those skilled in the art.

BRIEF DESCRIPTION OF THE DRAWINGS

Other features and advantages of the present invention will appear upon reading the following description, which is given purely by way of non-limiting example, with reference to the annexed drawings, in which.

DETAILED DESCRIPTION OF THE ILLUSTRATIVE EMBODIMENTS

Figure 1:
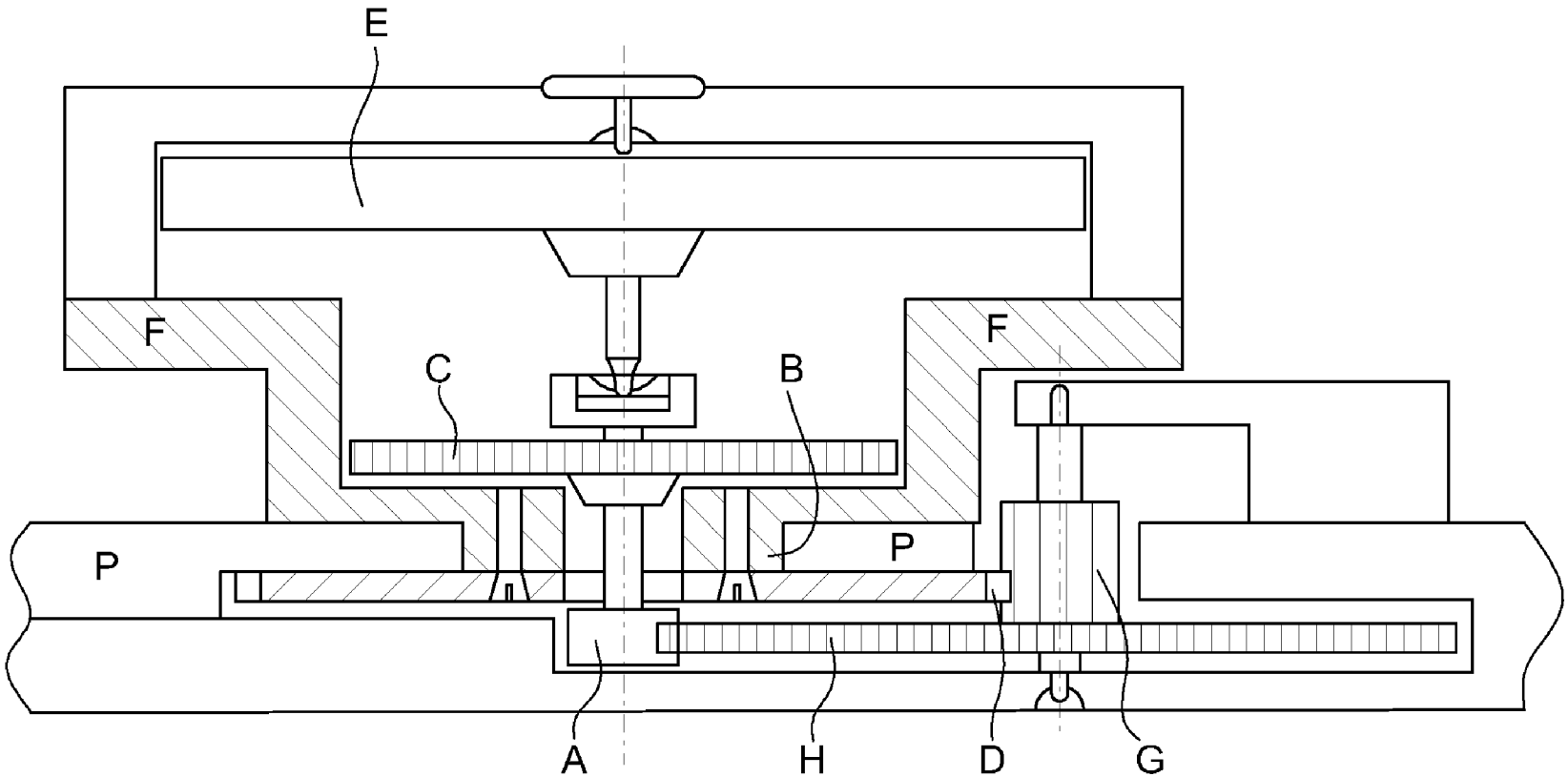
Fig. 1 (Prior Art)
FIG. 1, reproduced from CH Patent No. 7965 is a schematic cross-section of the gear train of a prior art karussel.
Figure 2:
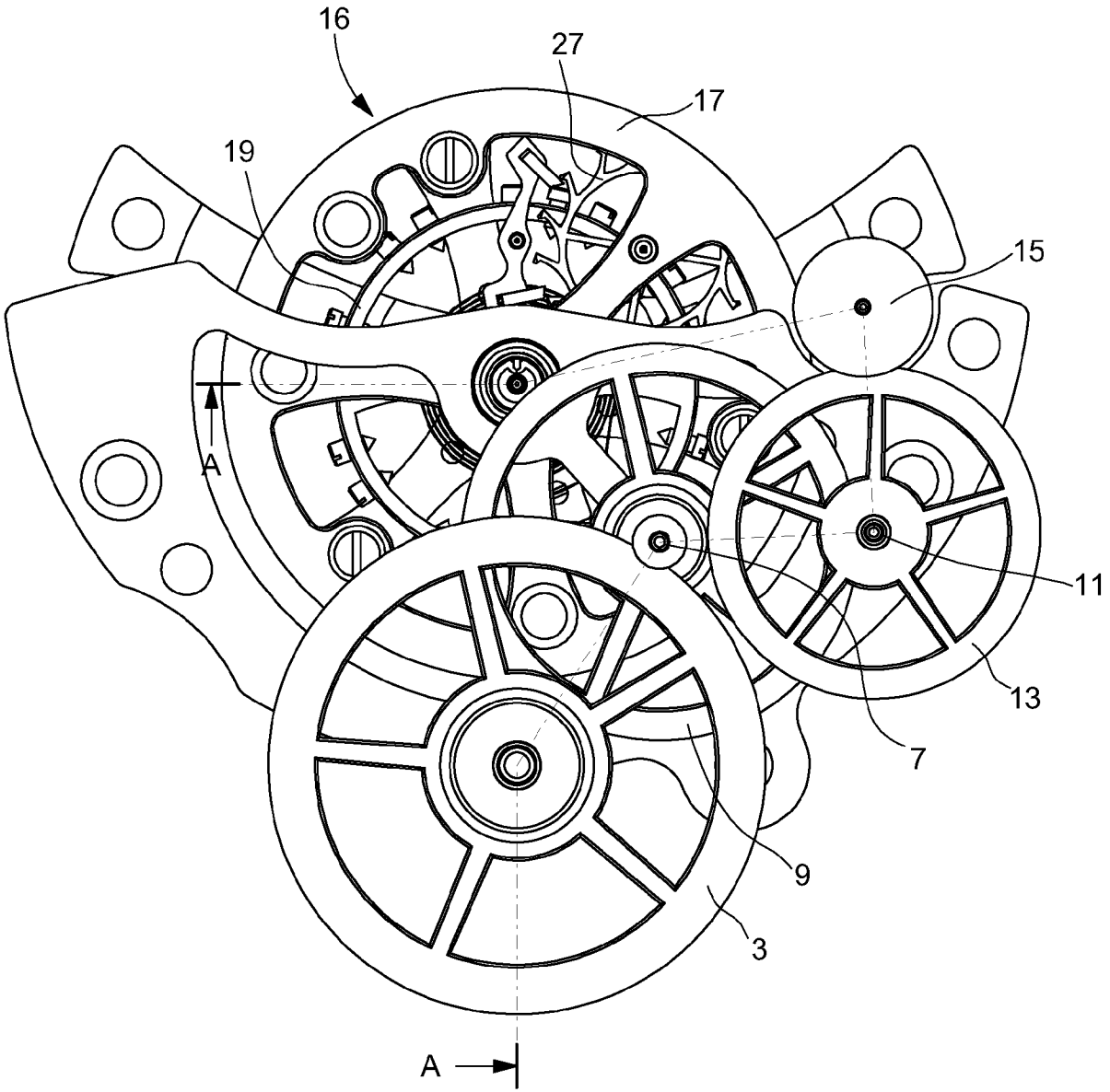
FIG. 2 is a plan view of the gear train that drives the karussel carriage of a timepiece movement according to a particular embodiment of the present invention.
Figure 3:
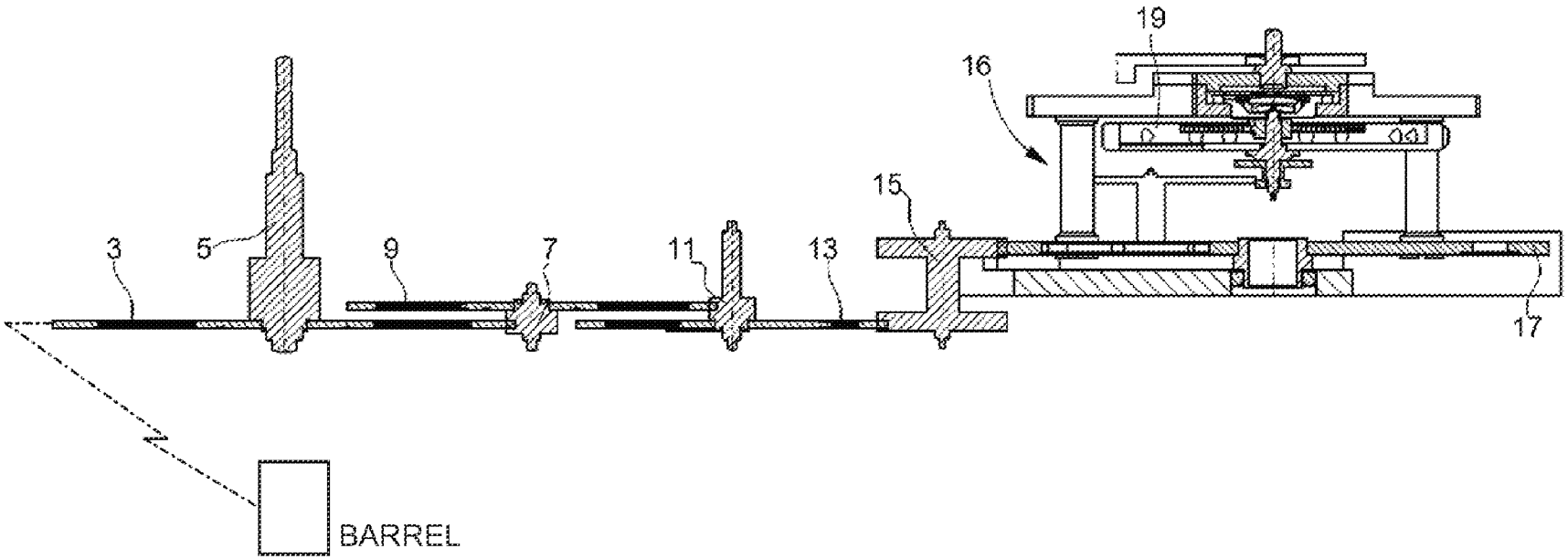
FIG. 3 is a schematic cross-section along A-A of FIG. 2.

The gear train driving the karussel carriage, which is shown in FIGS. 2 and 3, is a going type train. Thus, it includes a centre wheel 3, driven by a barrel (schematically shown), which completes one revolution per hour, in a conventional manner. The arbour 5 of the centre wheel is for carrying a minute hand. The gear train further includes a third wheel set that includes a third pinion 7 and a third wheel 9, and a karussel wheel 17, secured in rotation to the karussel carriage 16. Karussel wheel 17 is driven indirectly by the third wheel via two intermediary wheel sets, namely a first intermediary wheel set formed of pinion 11 and wheel 13 and a second intermediary wheel set referenced 15 and used as intermediate wheel. By analogy with a conventional going train, intermediary wheel set 11, 13 is called "fourth inter wheel set" below.

It will be clear from the foregoing that, in the present example, as karussel wheel 17 is separated from centre wheel 3 by an odd number of wheel sets, these two wheels rotate in the same direction. Moreover, the gear ratio between third pinion 7 and centre wheel 3 is 11¼, whereas the gear ratio between fourth inter pinion 11 and third wheel 9 is 9⅗, and that the gear ratio between karussel wheel 17 and fourth inter wheel 13 is ⅚. It can therefore be calculated that karussel 16 rotates 60 times faster than the centre wheel. It thus completes 1 revolution per minute.

The Figures also show that karussel 16 carries balance 19 and the escape mechanism. In the present example, the escape mechanism is of a conventional type. It includes an escape wheel 27, which is visible, in particular, in FIG. 2 (the escape mechanism is not shown in FIG. 3).

Figure 4:
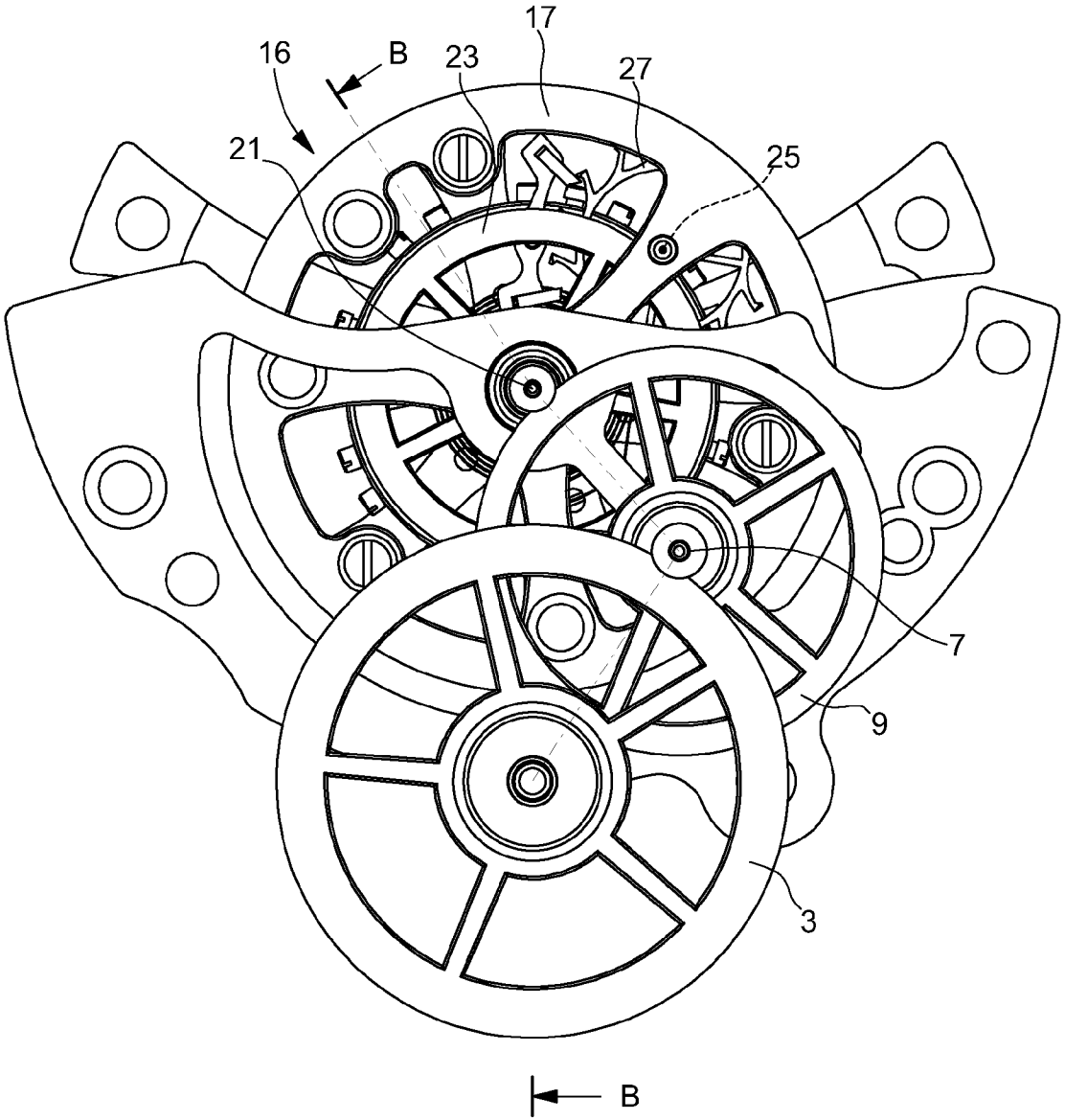
FIG. 4 is a plan view of the gear train that drives the escapement of the timepiece movement of FIG. 2.
Figure 5:
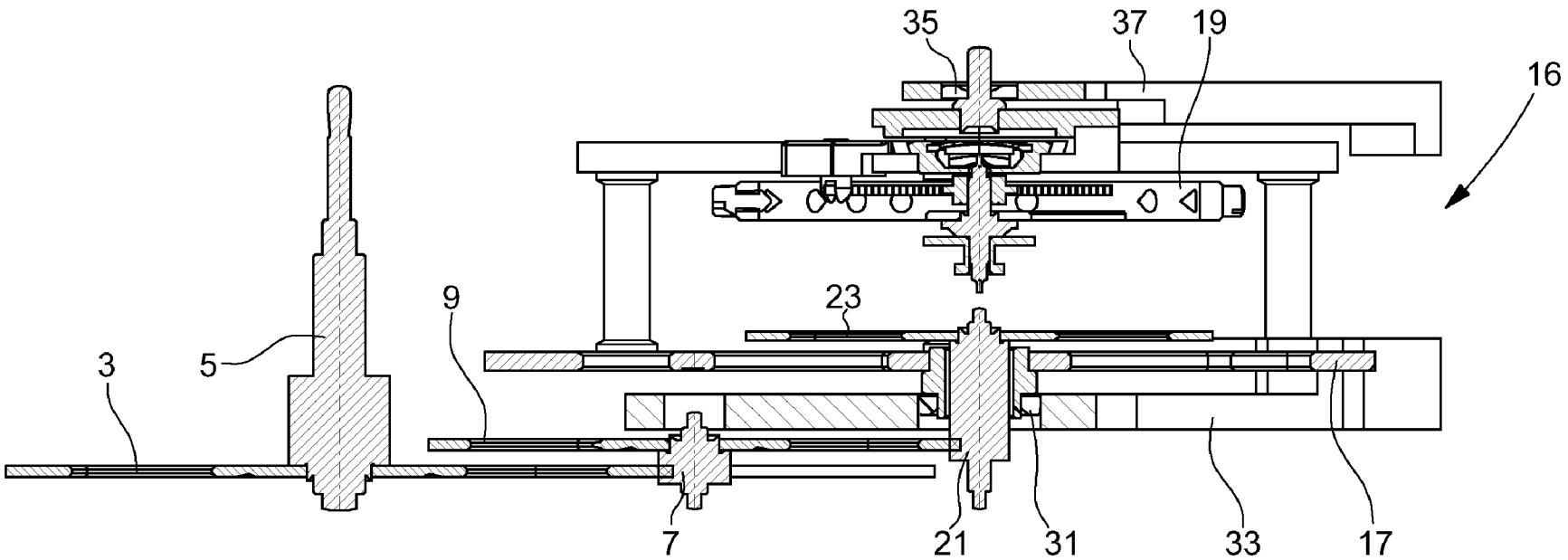
FIG. 5 is a schematic cross-section along B-B of FIG. 4.
Figure 6:
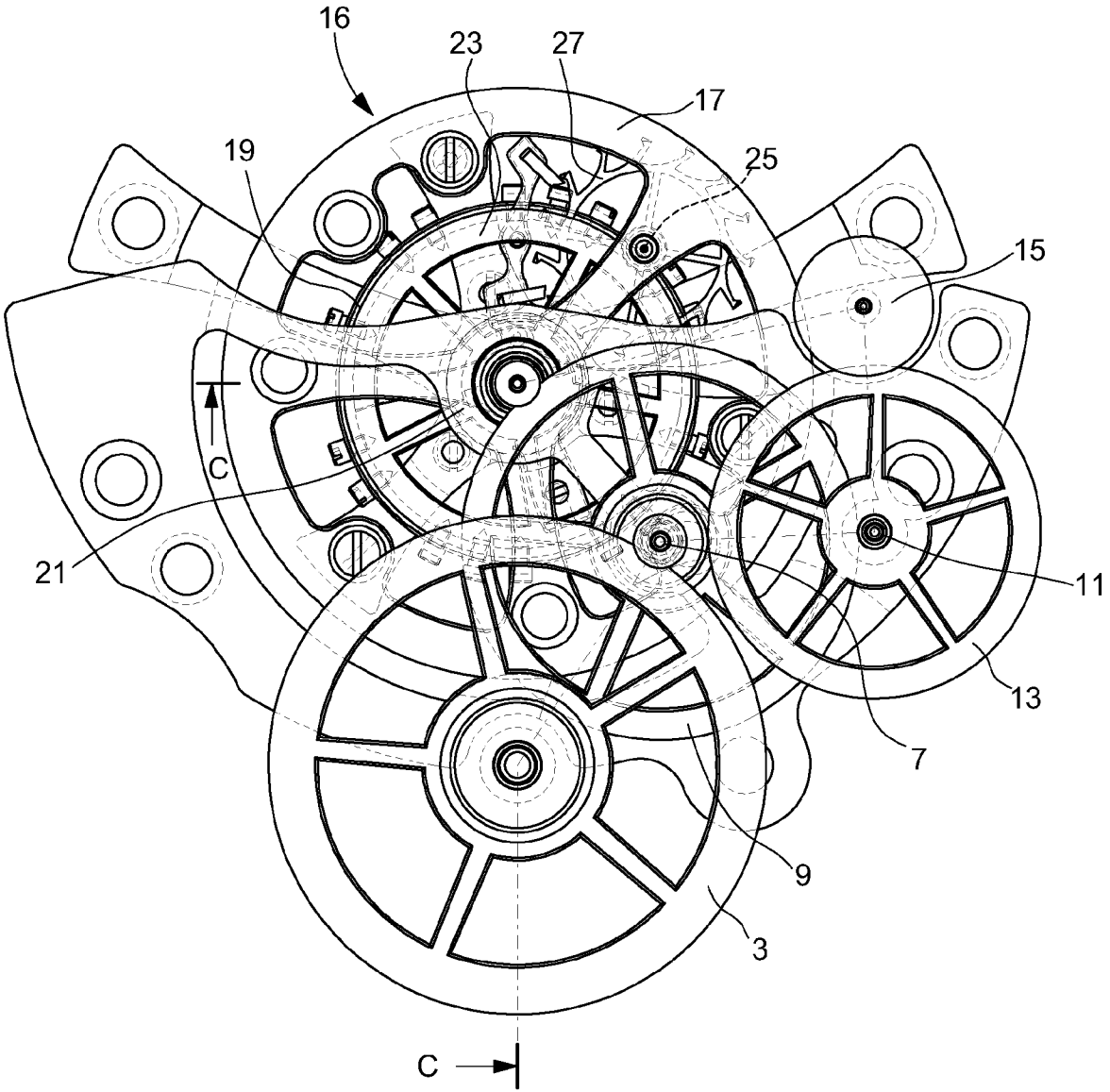
FIG. 6 is a plan view of the complete karussel gear train of FIG. 2.

FIGS. 4 and 5 show the gear train that connects the barrel (not shown) to escape wheel 27. The gear train of FIGS. 4 and 5 is also of the going type and shares some of its wheel sets with the gear train of FIGS. 2 and 3. The train that drives the escapement includes centre wheel 3, third wheel set 7, 9 and the escape wheel set, formed of an escape pinion 25 and escape wheel 27. The escape pinion is driven indirectly by third wheel 9 via an intermediary wheel set, formed of pinion 21 and wheel 23. By analogy with a conventional going train, pinion 21 and wheel 23 are respectively called the "false fourth" pinion and wheel below.

According to the present invention, one of the wheel sets of the escape drive train is arranged for rotating coaxially with karussel wheel 17 and thus also with the karussel carriage 16. As FIG. 5 shows, in the present example, it is false fourth wheel set 21, 23 which rotates coaxially with the karussel. Moreover, as was already stated, escapement 25, 27 and balance 19 are mounted in carriage 16 and therefore rotate therewith.

It was already observed that the gear ratio between third pinion 7 and centre wheel 3 is 11¼. Moreover, the gear ratio between false fourth pinion 21 and third wheel 9 is 10⅔. It can therefore be calculated that the false fourth wheel rotates 120 times faster than the centre wheel. Moreover, a single wheel set separates the false fourth wheel set 21, 23 from centre wheel 3. In these conditions, false fourth wheel 23 rotates in the same direction as the centre wheel, and thus also rotates in the same direction as the karussel carriage.

According to the present invention, the karussel carriage rotates at the speed of one revolution per minute. Given the gear ratios used in the present example, it can be deduced that the centre wheel completes one revolution per hour. The speed of arbour 5 of the centre wheel is thus adequate to carry a minute hand. It also follows from the gear ratios selected that the false fourth wheel 23 completes two revolutions per minute. As this latter wheel is rotating in the same direction as carriage 16, it can be deduced that, in this example, the speed of the false fourth wheel 23 relative to the carriage is one revolution per minute.

It will be clear from the foregoing that one advantageous consequence of the gear ratios implemented in this example is that the balance and escapement can operate at the same frequency as in a normal timepiece movement. Indeed, as the escapement is mounted in the carriage, it must therefore regulate the false fourth wheel at the usual speed of one revolution per minute. Owing to this feature, it is possible to use a standard balance and escapement to make the timepiece movement of this example. One may, for example, choose a balance 19 with a frequency of 3 Hz, an escape wheel with fifteen teeth, and a gear ratio of twelve between escape pinion 25 and false fourth wheel 23.

As can be seen in FIG. 5, in this example, the carriage arrangement is conventional. This carriage is pivotably mounted between bearing 31 of the carriage bridge 33 and bearing 35 of the bar bridge 37. The cross-section of FIG. 5 shows another peculiarity made possible by the present invention. One can see that balance 19 is arranged coaxially with karussel carriage 16. Although this arrangement is aesthetically advantageous, it could cause some problems. Indeed, the balance staff extends in the extension of the (false) fourth wheel set 21, 23, between the dial (not shown) and said wheel set. It will be clear that, in these conditions, it is problematic to extend the arbour of the fourth wheel set to make it carry a hand visible on the dial side. However, since, according to the present invention, it is karussel carriage 16 that rotates at a speed of one revolution per minute, the carriage can replace the fourth wheel set and carry the second indicator itself.

Figure 7:
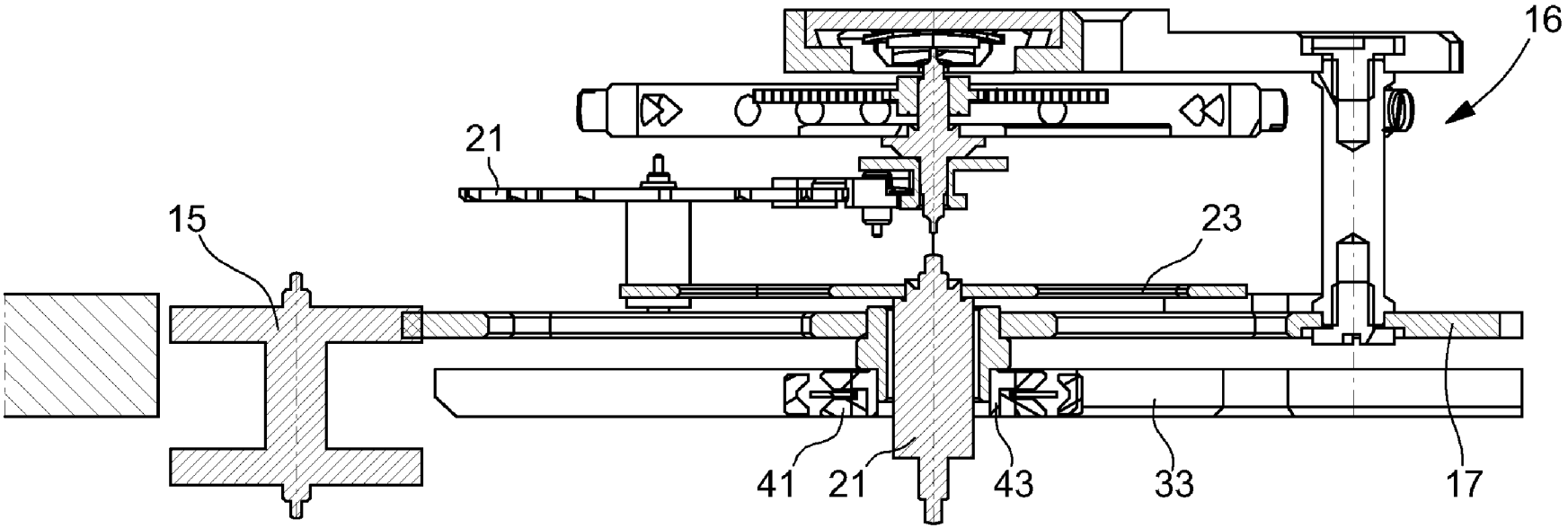
FIG. 7 is a schematic cross-section illustrating an alternative embodiment of the karussel carriage.

FIG. 7 shows a "flying" karussel, which forms an alternative embodiment of the karussel of the preceding Figures. According to this variant, the gear trains and the escapement are identical to those disclosed with reference to FIGS. 2 to 6. By comparing FIG. 7 to FIG. 5, one can see that a ball bearing 41 has replaced bearing 31 in carriage bar 33. Like bearing 31 of FIG. 5, the boss 43 of the bearing shown in FIG. 7 is traversed by a vertical, cylindrical aperture that allows the false fourth wheel set 21, 23 to pass through. FIG. 7 also shows that the external ring of the ball bearing is secured in carriage bar 33, whereas the boss 43 carries karussel wheel 17 and thus also the carriage as a whole. Owing to this arrangement, bar bridge 37 (FIG. 5) and bearing 35 can be omitted. Thus, in this variant, the carriage is mounted on a single pivot, which carries the carriage by the base. Moreover, the top of the carriage is completely free. The karussel thus gives the impression that it is flying above the movement, hence the name "flying karussel".

It will be clear that various alterations and/or improvements that are evident to those skilled in the art could be made to the embodiment forming the subject of this description, without departing from the scope of the present invention, as defined by the annexed claims. In particular, those skilled in the art could alter the gear trains by removing or adding wheel sets or by changing the gear ratios. The only constraint is that the karussel wheel 17 must rotate in the same direction and at a speed 60 times greater than the minute arbour 5. It is important to understand that there is absolutely no need for the speed of intermediary wheel set 21, 23 relative to carriage 16 to be equal to one revolution per minute. The present invention does not actually impose any constraints as regards the speed of intermediary wheel 23. The intermediary wheel set may, as in the preceding example, rotate faster than the carriage in the same direction as the latter. However, it may just as well rotate more slowly than the carriage in the same direction, or even rotate in the opposite direction to the carriage. Those skilled in the art will not have any difficulty in making these alternative karussels. Indeed, they know how to manufacture balances and/or escapements that can regulate the rotation of a wheel at any speed different from one revolution per minute. Further, they know how to make escapements that rotate in one direction or another. In this regard, it is worth noting that if wheel 23 is rotating in the same direction, but not as fast as the carriage, its speed relative to the carriage is negative. In other words, wheel 23 rotates counter clockwise relative to the carriage 16.

Moreover, according to another embodiment of the present invention, with some similarities to the tourbillon which is disclosed in EP Patent No. 0,973,076, the (false) fourth wheel set 21, 23 that meshes with the escapement could be carried by carriage 16 in an off-centre position, like a planetary wheel. In these conditions, instead of being coaxial to the false fourth wheel set, the carriage would be arranged to rotate about the arbour of another intermediary wheel set, for example a wheel set (not shown in the Figures) inserted between the third wheel set 7, 9 and the false fourth wheel set 21, 23. The gear ratios could for example be selected such that the intermediary wheel set rotates in the same direction as the carriage but slightly more slowly. (Specifically, the intermediary wheel set could, for example, include a large pinion with 20 teeth arranged for meshing with wheel 9, such that the wheel set is animated at a speed of 54 revolutions per hour). In these conditions, relative to the carriage, which completes 60 revolutions per hour, the wheel of the intermediary wheel set could rotate at a reduced speed in the opposite direction (at a speed of 6 revolutions per hour, in this example). The gear ratio between the intermediary wheel set and the false fourth wheel set 21, 23 would then be determined such that the speed of rotation of the false fourth wheel 23 relative to the carriage is adapted to the rate of the escapement used (the wheel of the intermediary wheel set could for example have 90 teeth and the false second pinion 21 nine teeth). It will be clear in this new example that the false fourth wheel 23 rotates clockwise relative to the carriage, which means that an escapement that rotates in the usual direction (the same direction as in the first example) can be used.

According to a variant of this last embodiment of the present invention, instead of rotating slightly more slowly than the carriage, the wheel set inserted between the third wheel set 7, 9 and the false fourth wheel set 21, 23 could rotate slightly faster than the carriage. In these conditions, the false fourth wheel 23 would rotate anticlockwise relative to the carriage. As has been seen this feature does not, however, raise any real problem for those skilled in the art.

The invention claimed is:

1. A timepiece movement comprising:

a barrel, an escapement that has an escape wheel and pinion, and a balance and a going gear train for transmitting energy stored in the barrel to the escape wheel, wherein said going gear train includes a rotatable intermediary wheel kinematically connected to the barrel by a first portion of the gear train and meshing directly with the escape pinion, the escapement and the balance are mounted in a rotating karussel carriage kinematically connected to the movement and arranged for rotating coaxially about said intermediary wheel at a different speed from the speed of said intermediary wheel; wherein the movement imposes a speed of one revolution per minute on the carriage.

2. The timepiece movement according to claim 1, wherein the carriage is arranged for rotating clockwise and wherein the carriage also carries means for indicating seconds.

3. The timepiece movement according to claim 2, wherein the balance is arranged for oscillating coaxially with the carriage.

4. The timepiece movement according to claim 2, wherein the carriage is mounted on a single pivot that carries the carriage by the base, the top of the carriage being entirely free.

5. The timepiece movement according to claim 2, wherein said intermediary wheel is arranged for rotating clockwise at a higher speed than the speed of rotation of the carriage.

6. The timepiece movement according to claim 5, wherein the balance is arranged for oscillating coaxially with the carriage.

7. The timepiece movement according to claim 5, wherein the carriage is mounted on a single pivot that carries the carriage by the base, the top of the carriage being entirely free.

8. The timepiece movement according to claim 2, wherein said intermediary wheel is arranged for rotating in the same direction as the carriage at a lower speed than the speed of rotation of the carriage.

9. The timepiece movement according to claim 8, wherein the balance is arranged for oscillating coaxially with the carriage.

10. The timepiece movement according to claim 8, wherein the carriage is mounted on a single pivot that carries the carriage by the base, the top of the carriage being entirely free.

11. The timepiece movement according to claim 1, wherein the balance is arranged for oscillating coaxially with the carriage.

12. The timepiece movement according to claim 1, wherein the carriage is mounted on a single pivot that carries the carriage by a base, a top of the carriage being entirely free.

13. The timepiece movement according to claim 12, wherein said pivot includes a ball bearing.

14. The timepiece movement according to claim 1, wherein a karussel wheel rotates in a same direction and at sixty times the speed of a minute arbour.

* * * * *